US005183200A

United States Patent [19]

Okamoto

[11] Patent Number: 5,183,200

[45] Date of Patent: Feb. 2, 1993

[54] FOLDER TYPE PAPER BOX

[76] Inventor: Haruo Okamoto, 1291-133, Oaza Yokose, Oita-shi, Oita 870-11, Japan

[21] Appl. No.: 756,960

[22] Filed: Sep. 9, 1991

[30] Foreign Application Priority Data

Oct. 18, 1990 [JP] Japan ..... 2-109540[U]

[51] Int. Cl.[5] ..... B65D 5/36

[52] U.S. Cl. ..... 229/23 R; 229/23 A; 229/117; 229/117.01

[58] Field of Search ..... 229/23 R, 23 A, 117.01, 229/117, 120.01

[56] References Cited

U.S. PATENT DOCUMENTS

| | | | |
|---|---|---|---|
| 3,021,044 | 2/1962 | Schubert | 229/23 A |
| 3,638,852 | 2/1972 | Solonka | 229/117.01 |
| 4,103,819 | 8/1978 | Muise | 229/23 R |
| 4,331,234 | 5/1982 | Gilbert | 206/600 |
| 4,373,637 | 2/1983 | Shippell | 206/600 |
| 4,477,015 | 10/1984 | Lozaun | 229/23 R |
| 4,504,497 | 3/1985 | Kurth et al. | 229/23 R |
| 4,655,366 | 4/1987 | Sykes | 229/23 R |
| 4,694,986 | 9/1987 | Chou | 229/23 R |
| 4,712,687 | 12/1987 | Silcott et al. | 229/117.01 |
| 4,746,059 | 5/1988 | Jackson | 229/23 R |
| 4,793,494 | 12/1988 | Gordon, Jr. | 229/23 R |

FOREIGN PATENT DOCUMENTS 42-5795 3/1967 Japan .

OTHER PUBLICATIONS

Pamphlet of Oujishiko Co., Ltd., published Oct. 1989.

*Primary Examiner*—Allan N. Shoap
*Assistant Examiner*—Christopher McDonald
*Attorney, Agent, or Firm*—Armstrong, Westerman, Hattori, McCleland & Naughton

[57] ABSTRACT

A box container having a bottom plate on which a rift is formed through one pair of opposite angles and a fold is running through each center of the other pair of opposite angles and having side plates each of which is connected in one piece to the periphery of said bottom plate, wherein the box container is pressed to be flat so as not to be bulky in transportation and storage and, in the case of assembling this box container, the bottom plate is unfolded to be flat along the folds which were provided on the bottom plate of said box container and, further, the whole of the bottom plate is fixed by sticking a quadrangular back plate thereto.

12 Claims, 7 Drawing Sheets

FOLDER TYPE PAPER BOX

FIELD OF THE INVENTION

The present invention relates to a folder type paper box which can be flattened for storage so as not to be bulky in transportation. Here, the paper includes synthetic paper made from synthetic resin, etc. as well as natural paper made from pulp, etc.

DESCRIPTION OF THE PRIOR ART

In conventional practice, there has been a problem that a large amount of boxes are difficult to store and transport because they are transported and stored in a completed state and become bulky.

To overcome such a problem, there were folder type paper boxes that were developed to be flat and given pasting overlaps at the portion to be jointed. However, in such a case, there has been a problem that they are extremely complicated to assemble and require a skill for assembly.

The inventor of this invention offered a folder type paper box stated in Japanese Laid-Open 2-83223 which was opened on Jun. 27, 1990. That folder type paper box had such a construction that there were provided four side plates around a quadrangular bottom plate and, around one of said side plates, a belt-like outer binding plate was fixed which was to be sticked around aforesaid four side plates, wherein all the plates were united by use of pressure sensitive adhesive at the time of assembly.

However there has been a problem that the assembly of this folder type paper box becomes troublesome and requires some extent of skill because said folder type paper box is transported in a flattened state and, as a result, the four abutting side plates were separated from each other and said respective side plates must be united by use of aforesaid outer binding plate one by one and, further, aforesaid outer binding plate is not of an endless type but having ends, whose uniting portions must be provided with a pasting overlap and require jointing.

SUMMARY OF THE INVENTION

The present invention has been made in view of above-mentioned circumstances and, accordingly, it is an object of this invention to provide a folder type paper box which is flattened in transportation and is possible to assemble by bonding only one face in assembly.

The folder type paper box relating to the present invention with aforesaid object comprises a box container having a quadrangular bottom plate and side plates each of which is connected to said bottom plate and both ends of which are foldably united to the ends of abutting side plates, a rift running through one pair of opposite angles formed on aforesaid bottom plate, a linear fold running through each center of the other pair of opposite angles, a back plate fixed to a part of aforesaid bottom plate, and a bonding portion which is disposed on either aforesaid back plate or aforesaid bottom plate and which sticks the back plate to the other portions of the bottom plate separated by aforesaid rift.

In the case of folder type paper box according to this invention, because there is formed a rift running through one pair of opposite angles and there are provided two folds each of which runs through each center of the other pair of opposite angles of the quadrangular bottom plate, it is possible to flatten the box by pressing it laterally, opening the bottom plate from said rift and folding it along said fold.

By this design, said folder type paper box can be transported in a flat state.

And, in the case of assembling said folder type paper box, the folded bottom plate is unfolded, the separated rift is adjusted, the back plate fixed to one part of bottom plate is bonded to the other part of the bottom plate and, by making and keeping the bottom plate flat, the whole components become a box-shape state.

Thus, the folder type paper box according to this invention can be transported in a flat state and has become very easy to manufacture and assemble, allowing an assembly by a person not skilled in assembly because it can be assembled by sticking only one face.

Here, this invention is applied to a folder type paper box having a lid plate which is foldably united in one piece to aforesaid back plate via a connecting plate which becomes a side plate, a folder type paper box having aforesaid box container provided with a lid whose structure is the same as that of said box container, and a folder type paper box having a rectangular sleeve type outer casing into which aforesaid box container united with aforesaid back plate slides, and at one side of which a stopper is provided.

DETAILED DESCRIPTION OF THE PREFERRED EMBODIMENT

Figure 1:
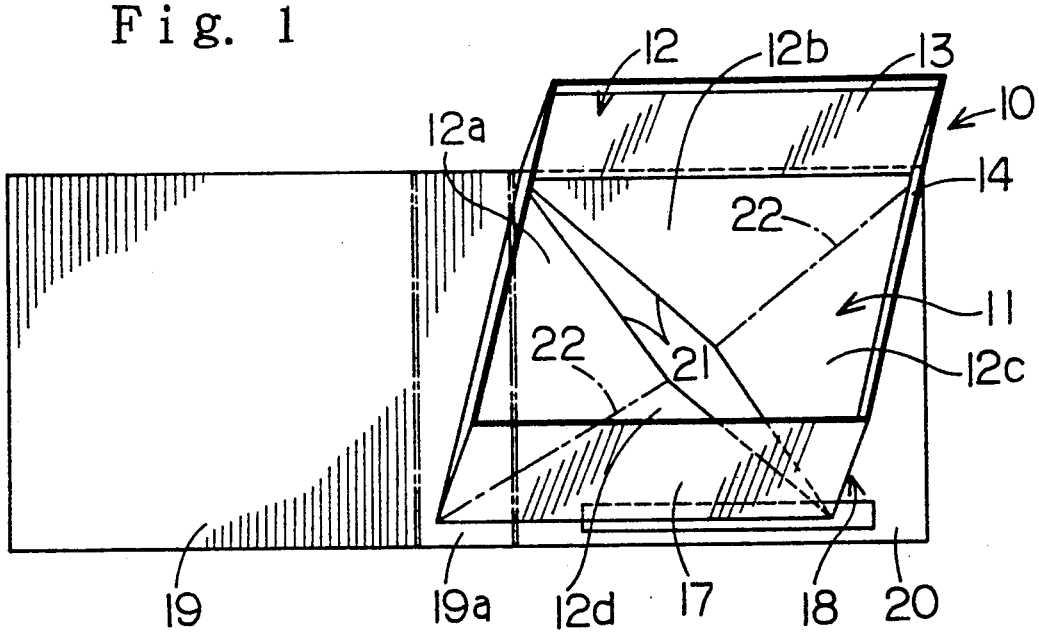
FIG. 1 is a perspective view showing the state under assembly of a folder type paper box relating to the first embodiment of this invention.
Figure 2:
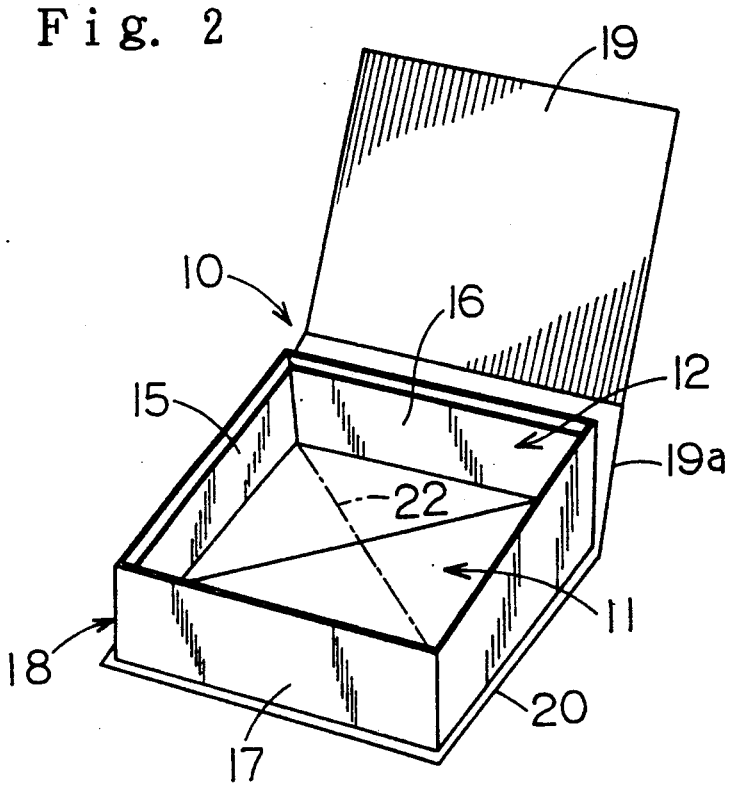
FIG. 2 and FIG. 3 are perspective views showing the completed state of said folder type paper box.
Figure 3:
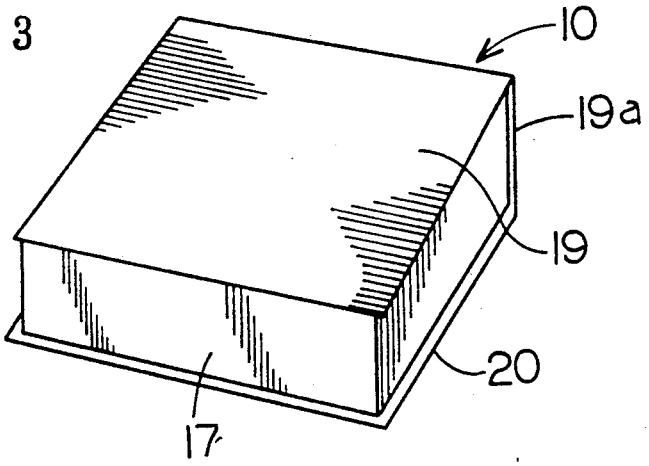

As shown in FIGS. 1 through 3, the folder type paper box 10 relating to the first embodiment of this invention comprises a box container 18 provided with an inner box 12 having a quadrangular bottom plate 11 and an outer binding plate 17 which is sticked to the inner side plates 13 through 16 of said inner box 12, and a back plate 20 which is sticked to the back face of aforesaid bottom plate 11 and to which a connecting plate 19*a* and a lid plate 19 are foldably united. The details of these components will be explained hereinbelow.

Figure 4:
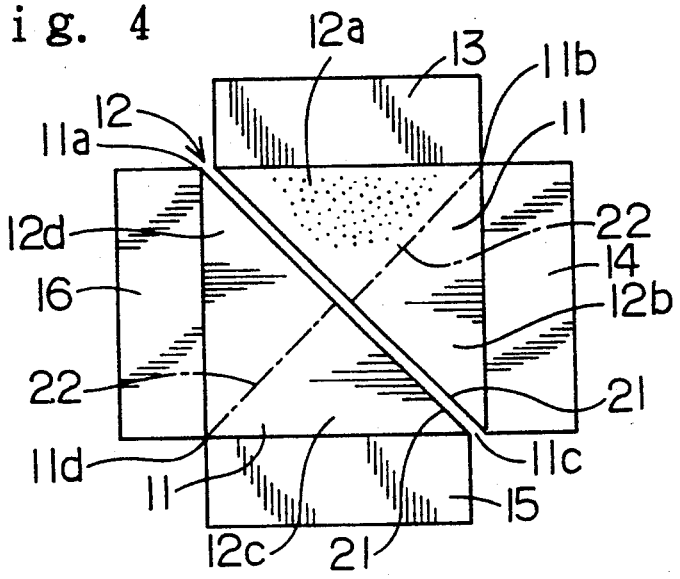
FIG. 4 is a developed plan view of an inner box which composes said folder type paper box.
Figure 7:
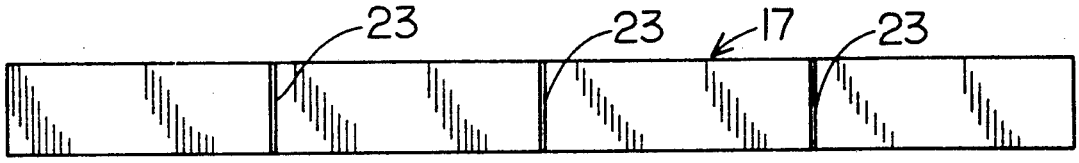
FIG. 7 is a developed plan view of the outer binding plate to be used for said folder type paper box.

As shown in FIG. 4, aforesaid inner box 12 has a quadrangular bottom plate 11. There is formed a rift along the diagonal line connecting one pair of opposite angles 11*a* and 11*c* of the bottom plate 11, and there is provided a fold 22 along each bisector of the other pair of opposite angles 11*b* and 11*d*, by which the bottom plate 11 is divided into small portions 12*a* through 12*d*. Here, if the bottom plate 11 is of a square, aforesaid fold 22 becomes a diagonal line connecting the opposite angles 11*b* and 11*d*. To the inner side plates 13 through 16 of aforesaid inner box 12, there is sticked from outside an outer binding plate 17 shown in FIG. 7 which becomes a little higher than said inner side plates 13 through 16 when made into a box, thus composing the side plates of the box container 18.

Figure 5:
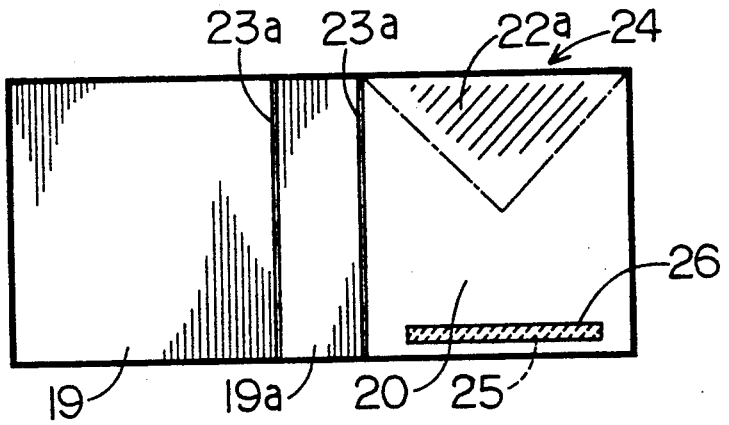
FIG. 5 is a plan view of a back plate to which a lid plate and a connecting plate are united.

And, on the back face of aforesaid bottom plate 11, a part 22*a* of a relatively thick template 24 consisting of a back plate 20, a connecting plate 19*a*, and a lid plate 19 as shown in FIG. 5 is sticked partially to the back face of a small portion 12*a* formed between the rift 21 and the fold 22 of said bottom plate 11 so that the template 24 may not separate from the bottom plate 11. In addition, the number 23*a* in FIG. 5 and number 23 in FIG. 7 mean fold portions respectively.

On the other portion facing aforesaid bonding portion of aforesaid back plate 20, there is provided a pressure sensitive portion 25 which is one example of bonding portions. And, said pressure sensitive portion 25 is normally applied with a weak adhesive seal 26 and, at the time of assembling the box, said seal 26 is peeled off so that the pressure sensitive portion 25 may be sticked to the back face of small portion 12*c* of the bottom plate 11.

Figure 6:
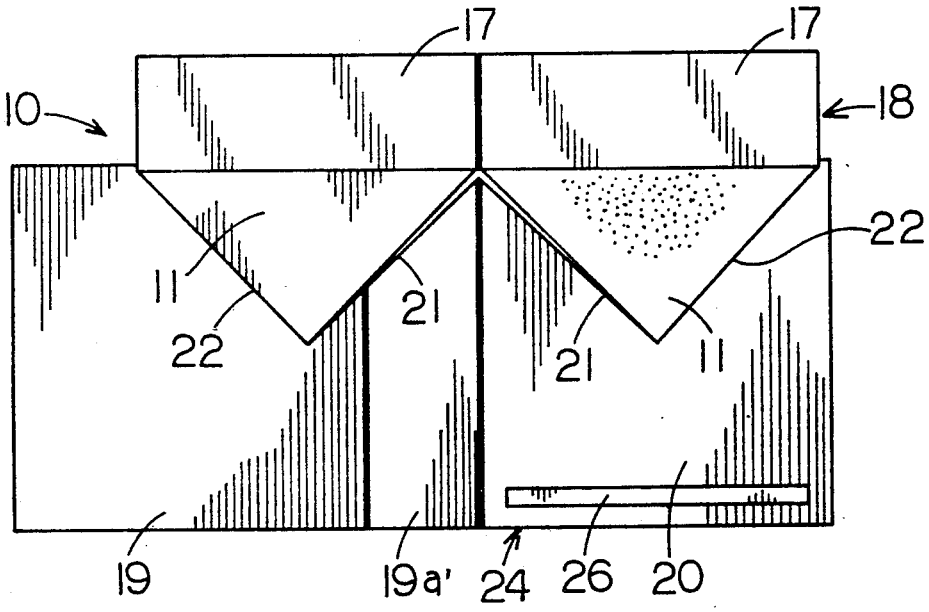
FIG. 6 is a plan view of said folder type paper box in a flattened state.

Accordingly, at the time of transporting or storing this folder type paper box 10, aforesaid box container 18 is first separated from the rift 21 and folded along the folds 22 as shown in FIG. 6 so that the whole body of box container 18 may be flattened, the bottom plate 11 is folded to be a W-shape state as shown in FIG. 6, and said template 24 which is partially sticked to a part of said bottom plate 11 is developed to be flat, and then the box is made convenient for transportation and storage.

Then, at the time of assembling this folder type paper box 10 as a container, the side plates of box container 18 are unfolded to be a box shape. By this process, the bottom plate 11 is unfolded along the folds 22 to be flat, and the whole body of the box container 18 becomes a box-like state. Then the seal 26 is peeled off, and the pressure sensitive portion 25 is exposed and fit tight to the back face of the bottom plate 11 so that the back plate 20 may stick to the bottom plate 11.

After above-mentioned process, by making the connecting plate 19*a* stand and putting the lid plate 19 on the top, a folder type paper box 10 shown in FIGS. 2 and 3 is completed. In addition, it is within manufacturer's discretion to dispose a decoration bottom paper to the inside surfaces of the bottom plate 11 or to stick a decoration paper to the top end of inner side plates 13 through 16 and the outer binding plate 17.

It is further possible (same as in the embodiments hereinbelow) to attach a double-side adhesive tape instead of aforesaid pressure sensitive portion 25, and to provide a bonding portion on the bottom plate 11.

Here, it is possible to manufacture a folder type paper box which is flattened by pressing even if aforesaid folds (not necessary to be on the diagonal line in this case) are replaced with rifts, but more portions to be sticked become necessary in this case. Therefore the folder type paper box 10 according to aforesaid embodiment is easier to assemble.

Further, in the case of aforesaid embodiment, a square bottom plate was used and, in case of using a rectangular bottom plate other than a square one, the rift is not necessary to be formed along the diagonal line but enough along a line (including a straight and a curved line) connecting the opposite angles (same as in the embodiments hereinbelow) though the folds are necessary to be provided along the lines each of which bisects (produces, therefore, two 45° angles) each of the opposing vertical angles.

Then the explanation will be made on the folder type paper box shown in FIGS. 8 through 13 according to the second embodiment of this invention, wherein the same component numbers as those of the folder type paper box according to aforesaid first embodiment are given the same reference numbers, and the detailed explanation thereof is omitted.

Figure 8:
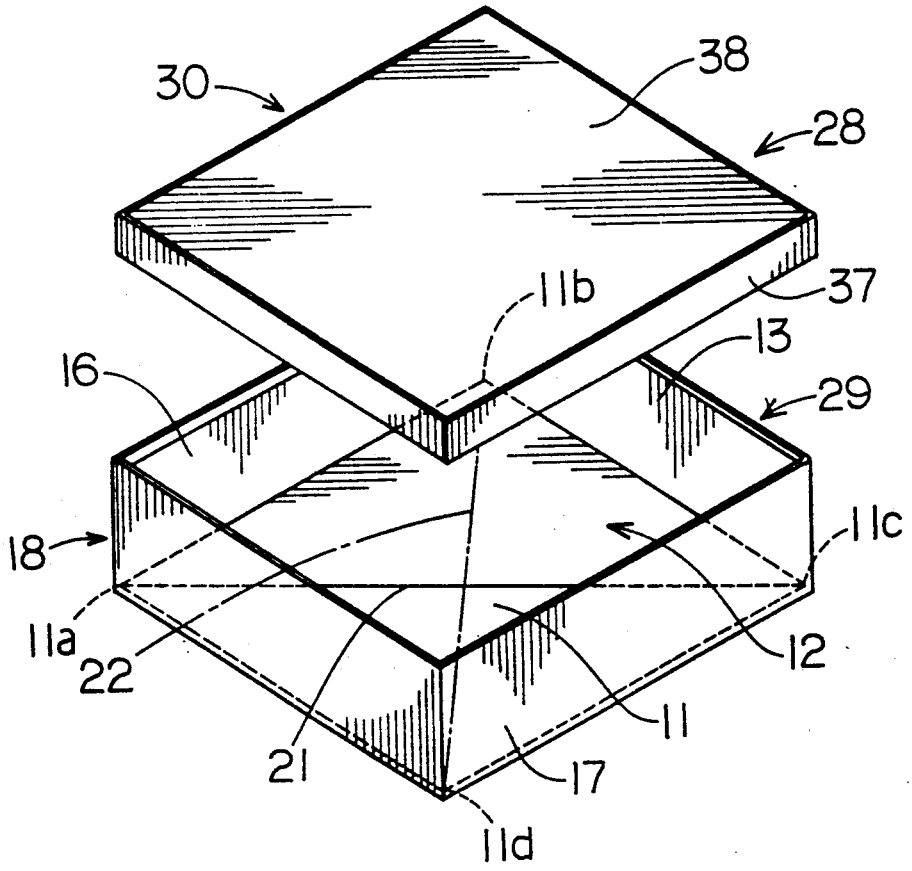
FIG. 8 is a perspective view showing the assembled state of a folder type paper box relating to the second embodiment of this invention.
Figure 9:
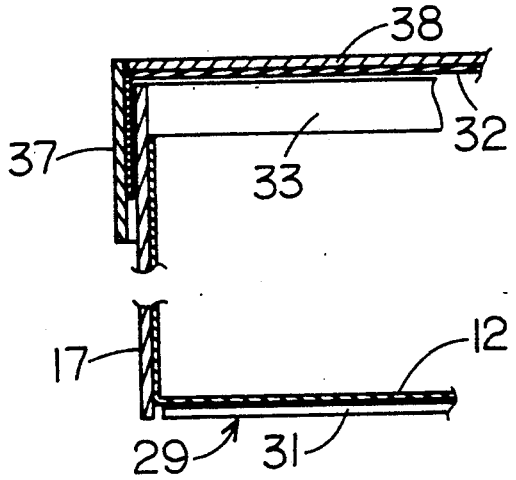
FIG. 9 is a partial sectional view of the same.
Figure 10:
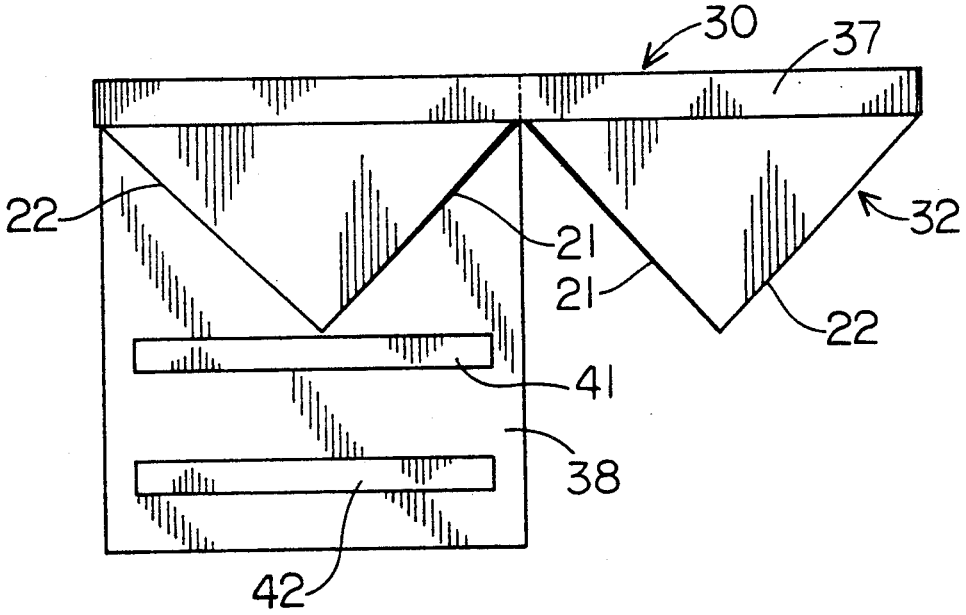
FIG. 10 is a plan view of flattened lid of said folder type paper box.
Figure 11:
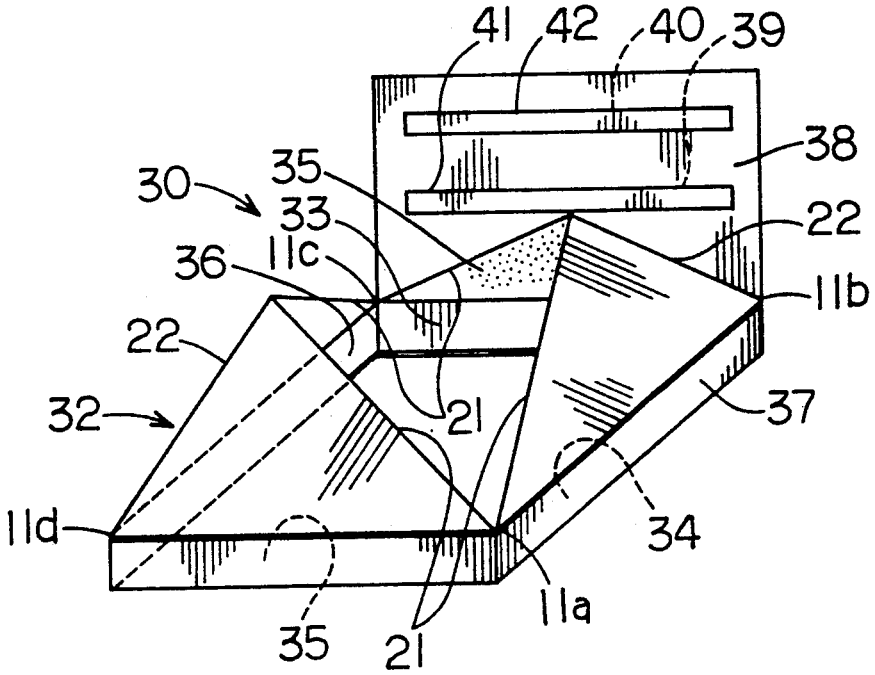
FIG. 11 is a perspective view showing the state under assembly of aforesaid lid.

As shown in FIG. 8 and FIG. 9, the folder type paper box 28 according to the second embodiment of this invention comprises a box body 29 having a quadrangular section and a lid 30 which is separated from said box body 29 and put onto the top of the box body 29.

Aforesaid box body 29 comprises a box container 18 provided with an inner box 12 having a quadrangular bottom plate 11 and an outer binding plate 17 which is sticked to each of the inner side plates 13 through 16 which are united in one piece to said inner box 12, and a back plate 31 which is sticked to the back face of aforesaid bottom plate 11. Aforesaid lid 30 consists of a ceiling plate 32 which is a little larger than aforesaid bottom plate 11, inner side plates 33 through 36 which are united in one piece to said ceiling plate 32, an outer binding plate 37 which is put around said inner side plates 33 through 36, and a top plate 38 which is sticked onto the outer face of aforesaid ceiling plate 32. The details of these components will be explained hereinbelow.

As shown in FIG. 8 and FIG. 9, there is formed a rift 21 along the diagonal line connecting one pair of opposite angles 11*a* and 11*c* of the bottom plate 11 and there is provided a fold 22 (shown with one-dot chain line) running nearly along each bisector of the other pair of opposite angles 11*b* and 11*d* (therefore producing two 45° vertical angles). To the outside of inner side plates 13 through 16 of aforesaid inner box 12, there is sticked an outer binding plate 17 which is a little higher than the inner side plates 13 through 16, thus composing the side plates of the box container 18. And, on the back face of aforesaid bottom plate 11, a quadrangular back plate 31 made of a relatively thick template is partially sticked to a portion formed between the rift 21 and the folds 22 so that the back plate 31 may not separate from the bottom plate 11 as same in the case of aforesaid folder type paper box 10.

Here, as shown in FIG. 9, the size of aforesaid back plate 31 is determined so that it may slip into the inside of the outer binding plate 17 which is in a standing state (it is also possible to let the back plate not slip into the inside of the outer binding plate).

As to aforesaid lid 30, because its structure is the same as that of aforesaid box body 29, the same component numbers are given the same reference numbers, and the explanation is omitted. However, the top plate 38 is provided with two pressure sensitive portions 39 and 40, on which protection seals 41 and 42 are disposed respectively.

Accordingly, at the time of transporting or storing this folder type paper box 28, the box container 18 to which not all the portions of back plate 31 are sticked and the lid 30 to which the top plate 38 is not sticked are pressed to be flat and, at the time of assembly, aforesaid box container 18 and aforesaid lid 30 are unfolded, the bottom plate 11 and the ceiling plate 32 are unfolded to be flat, the back plate 31 and the top plate 38 are sticked respectively to their mating portions, the box body 29 and the lid 30 are assembled, and then a folder type paper box 28 shown in FIG. 8 is completed.

In addition, it is within manufacturer's discretion to dispose a decoration paper to the inside surface of the inner box 12 and the inner lid 32, or to stick optional decoration papers to the other portions.

Then the explanation will be made on the folder type paper box shown in FIGS. 12 through 17 according to the third embodiment of this invention. And, as shown in the figures, the draw-out folder type paper box 44 according to the third embodiment of this invention comprises an outer casing body 45 made of paper and a box body 46 consisting of a bottom plate 11 which is stored in said outer casing body 45, a box container 18 having inner side plates 13 through 16, and a back plate 20 which is sticked to the back face of said box container 18. The abutting portions of the inner side plates 13 through 16 of aforesaid box container 18 are foldably united each other by use of an outer binding plate or a uniting sheet, etc. (not shown in the figures) so that the whole plates may be side plates forming in one piece a sleeve having a quadrangular section.

Figure 14:
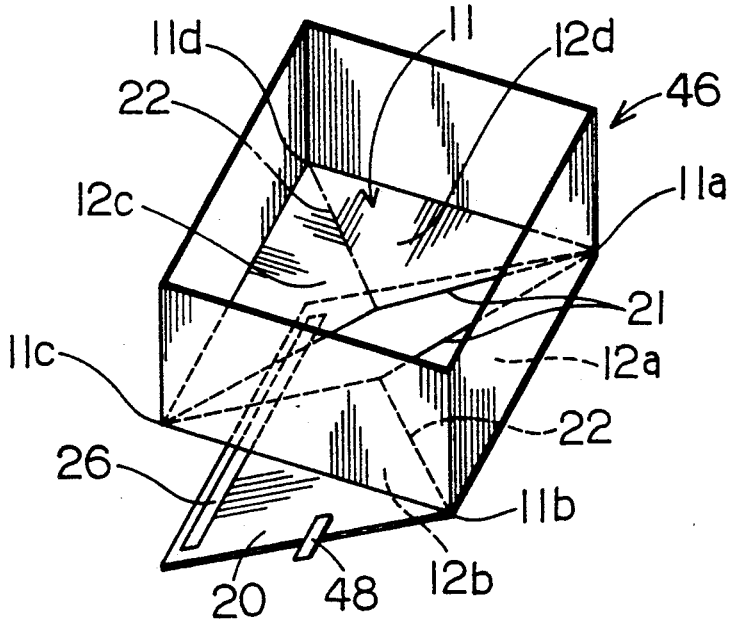
FIG. 14 is a perspective view showing the state under assembly of the box container of said folder type paper box.

On aforesaid bottom plate 11, as shown in FIG. 14, there is formed a rift 21 along the diagonal line connecting one pair of opposite angles 11*a* and 11*c*, and there is provided a fold 22 along each bisector of the other pair of opposite angles 11*b* and 11*d*, by which the bottom plate 11 is divided into small portions 12*a* through 12 *d*.

And, to the back face of the small portion 12*a* which is a part of aforesaid bottom plate 11, there is sticked a back plate 20 which is the same in shape as or a little larger than the bottom plate 11. To the other portion of said back plate 20, there is provided a pressure sensitive portion 25 whose surface is provided with a seal 26.

At one side of aforesaid bottom plate 11, there is provided a band (it is replaceable to use a braid, ribbon, or tag) 48 which is one example of draw-up members and, by pulling said band 48, the box body 46 can be drawn out of the outer casing body 45.

Figure 16:
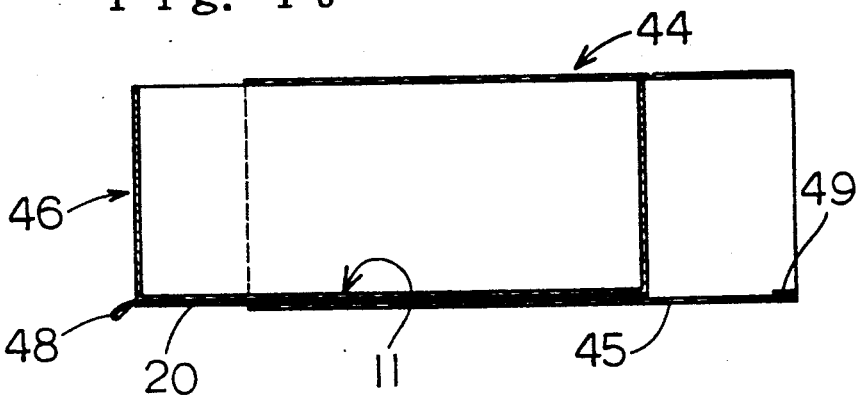
FIG. 16 is a sectional view of said folder type paper box.
Figure 17:
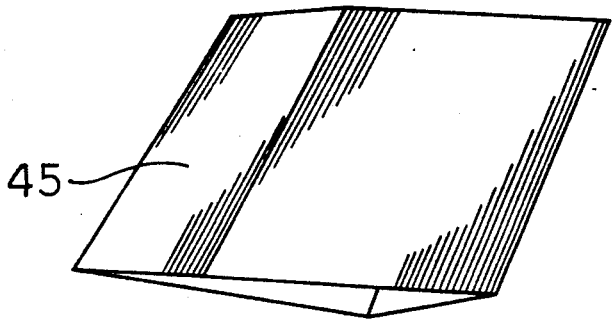
FIG. 17 is a perspective view showing an outer casing body in a flattened state of said folder type paper box.

Aforesaid outer casing body 45 has a sleeve-like shape as shown in FIGS. 16 and 17 and has a stopper 49 at one side therein so that the box body 46 may not go through.

Figure 15:
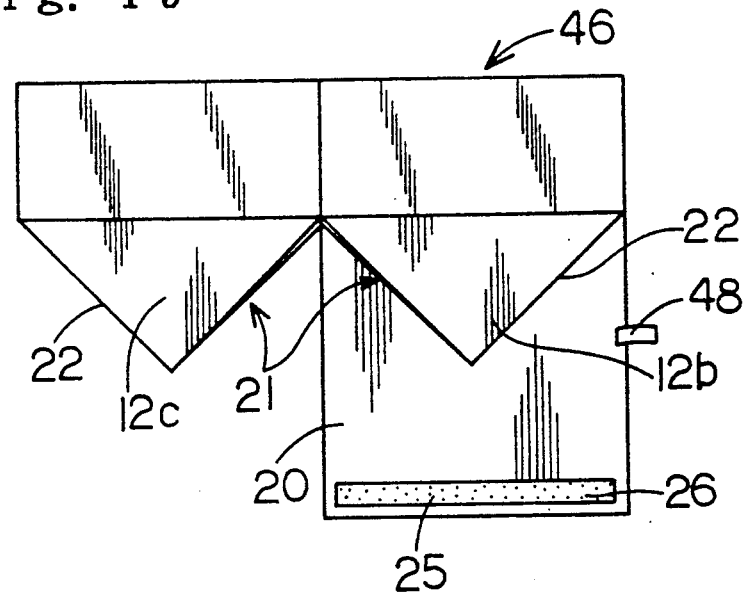
FIG. 15 is a plan view showing a box body in a flattened state.

Accordingly, in case of transporting this draw-out folder type paper box 44, the box body 46 is first pressed to be flat as shown in FIG. 15, and the outer casing body 45 is then pressed to be flat as shown in FIG. 17.

Figure 12:
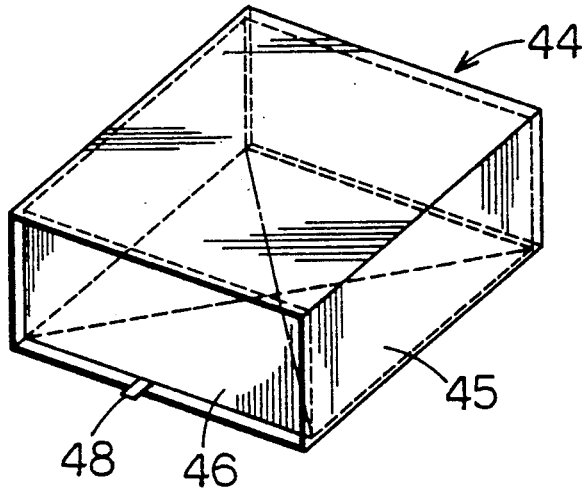
FIG. 12 and FIG. 13 are overall perspective views of a draw-out folder type paper box relating to the third embodiment of this invention.
Figure 13:
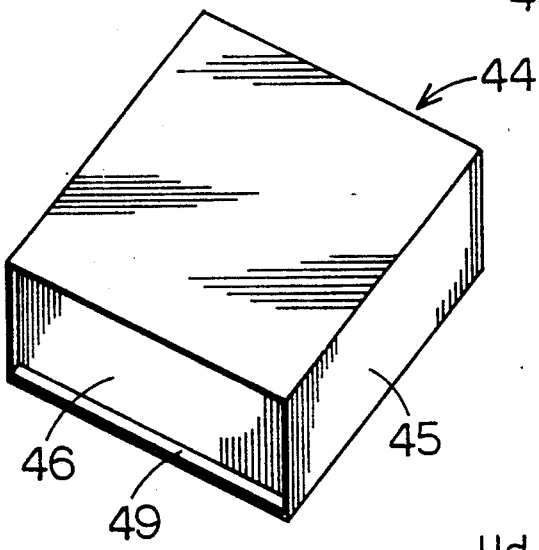

And, in case of assembling said folder type paper box 44, the box body 46 is pulled up to be assembled as shown in FIG. 14 and then inserted into the inside of the outer casing body 45 as shown in FIGS. 12 and 13. In this process, the box body 46 doesn't go through to the opposite side of the outer casing body 45 because there is provided a stopper 49 at one side of the outer casing body 45.

In case of drawing out said box body 46, the band 48 is pulled, with the outer casing body 45 being held.

What is claimed is:

1. A folder type box, comprising:

a box container and a lid body for fitting on said box container, said box container and lid body each comprising:

a quadrangular bottom plate having a rift running through a first pair of opposite angles formed thereon so as to form first and second bottom plate portions adjacent said rift, and a linear fold running through a center of a second pair of opposite angles of said first and second bottom plate portions; and a side plate connected to said quadrangular bottom plate; said folder type box further comprising:

a back plate fixed to said second portion of said bottom plate, said second portion separable from said first portion along said rift such that said box container and said lid body can each lay flat in a flat state; and means for bonding said second portion of said bottom plate separated along said rift to said back plate when said first and second portions of said bottom plate are brought together to close said rift such that said folder type box can be transformed from said flat state to a box state by a bond of said means for bonding.

2. The folder type box of claim 1, wherein said means for bonding comprises at least one of a pressure sensitive bonding portion with a seal thereon and a double-sided adhesive tape.

3. The folder type box of claim 2, wherein said means for bonding is disposed on at least one of said back plate and said bottom plate.

4. The folder type box of claim 1, wherein said bottom plate is a square, said rift is formed along the diagonal line of said first pair of opposite angles, and said fold is formed along the diagonal line of said second pair of opposite angles.

5. The folder type box of claim 1, further comprising rectangular sleeve outer casings, said box container and lid body attached to respective back plates being slidably and removably disposed within respective rectangular sleeve outer casings, wherein a stopper is provided at one side of each of said rectangular sleeve outer casings.

6. The folder type box of claim 1, wherein said box is made of at least one of synthetic paper and natural paper.

7. A box, comprising:

a box container and a lid body for fitting on said box container, said box container and lid body each comprising:

a back plate;

a first substantially triangular plate comprising an attaching portion for attaching said first triangular plate to said back plate, said first substantially triangular plate further comprising a folding portion hingedly connected to said attaching portion so as to be folded and lay flat upon said attaching portion in a first position, and so as to be unfolded and lay flat upon said back plate in a second position;

a second substantially triangular plate having a first portion hingedly provided adjacent said first substantially triangular plate, said second substantially triangular plate further comprising a folding and bonding portion hingedly provided on said first portion of said second substantially triangular plate so as to be folded and lay flat upon said first portion in a first position, and so as to be unfolded in a second position so that said first portion and said folding and bonding portion of said second substantially triangular plate lay adjacent said attaching and folding portions of said first substantially triangular plate on said back plate when said folding portion of said second substantially triangular shape is in said second position;

means for bonding said folding and bonding portion of said second substantially triangular plate to said back plate when said second substantially triangular plate is unfolded to lay adjacent said first substantially triangular plate on said back plate.

8. The box of claim 7, wherein said means for bonding comprises at least one of a pressure sensitive bonding portion with a seal thereon and a double-sided adhesive tape.

9. The box of claim 8, wherein said means for bonding is disposed on at least one of said back plate and said bottom plate.

10. The box of claim 8, wherein the box is made of paper.

11. The box of claim 7, further comprising rectangular plates hingedly connected to each of said first triangular attaching portion, said first triangular folding portion, said second triangular first portion, and said second triangular bonding and folding portion, wherein each of said rectangular plates is constructed so as to be folded at substantially a right angle to the respective portion to which it is hingedly connected so as to form four side walls of said box when said first triangular attaching portion and said second triangular folding and bonding portion are attached to said back plate.

12. The box of claim 11, further comprising outer binding plates for surrounding said four respective rectangular portions of said box container and lid body so as to reinforce said side walls of said box.

* * * * *